US012698785B2

(12) United States Patent
Vier et al.

(10) Patent No.: US 12,698,785 B2
(45) Date of Patent: Aug. 4, 2026

(54) LOW-NOISE FAN FOR INFORMATION HANDLING SYSTEMS

(71) Applicant: Dell Products L.P., Round Rock, TX (US)

(72) Inventors: Bradford Edward Vier, Austin, TX (US); Qinghong He, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 82 days.

(21) Appl. No.: 18/495,140

(22) Filed: Oct. 26, 2023

(65) Prior Publication Data

US 2025/0142767 A1 May 1, 2025

(51) Int. Cl.

*F04D 29/66* (2006.01)
*F04D 29/28* (2006.01)
*F04D 25/08* (2006.01)

(52) U.S. Cl.

CPC ..... *F04D 29/661* (2013.01); *F04D 29/281* (2013.01); *F04D 25/08* (2013.01)

(58) Field of Classification Search

CPC ..... F04D 17/00; F04D 29/281; F04D 25/08; F01D 5/145; F01D 5/141; F15D 1/003
USPC ..... 416/228, 231 B, 231 R, 236 R
See application file for complete search history.

(56) References Cited

U.S. PATENT DOCUMENTS 976,415 A * 11/1910 Webb et al. ..... F02M 29/02 122/17.1
7,044,720 B1 * 5/2006 Yamamoto ..... F04D 29/424 416/243
11,946,483 B2 * 4/2024 Ke ..... F04D 25/0613
2006/0177323 A1 * 8/2006 Hsieh ..... F04D 29/666 417/423.1
2009/0162210 A1 * 6/2009 Hwang ..... F04D 29/681 416/95
2012/0128486 A1 * 5/2012 Lin ..... F04D 17/16 415/224
2023/0383762 A1 * 11/2023 Ke ..... F04D 17/10
2024/0410396 A1 * 12/2024 Sen ..... G06F 1/203

FOREIGN PATENT DOCUMENTS

JP 2004353496 A * 12/2004 ..... F04D 29/282

* cited by examiner

*Primary Examiner* — Thomas Fink
(74) *Attorney, Agent, or Firm* — McDermott Will & Schulte LLP

(57) ABSTRACT

In one or more embodiments, a fan assembly may comprise a fan hub with a plurality of blades, each blade having one or more cutouts through which laminar airflow from a front side of the blade can pass through the blade to a back side of the blade, reducing aeroacoustic noise. A cutout may be a lateral cutout, wherein the lateral cutout connects to an edge of a blade, or may be an internal cutout, wherein an internal cutout may be formed relative to a midline of the blade but does not connect to either edge of the blade.

6 Claims, 6 Drawing Sheets

LOW-NOISE FAN FOR INFORMATION HANDLING SYSTEMS

BACKGROUND

Field of the Disclosure

This disclosure relates generally to fans cooling information handling systems and more particularly to low noise fans and systems for quietly cooling information handling systems.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

SUMMARY

Embodiments may be generally directed to a low noise fan, comprising a fan housing; a hub rotatably positioned in the fan housing; and a plurality of blades coupled to the hub, each blade comprising one or more cutouts formed a radial distance from the hub. In some embodiments, the one or more cutouts comprise a lateral cutout formed between an edge of a blade of the plurality of blades and a midline of the blade. In some embodiments, the one or more cutouts comprises a first lateral cutout formed between a first edge of the blade and a midline of the blade; and a second lateral cutout formed between a second edge of the blade and the midline of the blade. In some embodiments, the one or more cutouts comprise internal cutouts formed relative to a midline of the blade. In some embodiments, wherein the one or more cutouts comprise a first portion formed orthogonal to a length of the blade and a second portion formed parallel to the length of the blade. In some embodiments, each blade comprises a linear section, a curved section and a transition section, wherein the one or more cutouts are formed in a transition section between the linear section and the curved section.

Embodiments may be generally directed to a cooling system for an information handling system. The cooling system may comprise a motor and a fan assembly comprising: a fan housing; a hub coupled to an output shaft of the motor and positioned in the fan housing; and a plurality of blades coupled to the hub, each blade comprising one or more cutouts formed a radial distance from the hub. In some embodiments, the one or more cutouts comprise a lateral cutout formed between an edge of a blade of the plurality of blades and a midline of the blade. In some embodiments, wherein the one or more cutouts comprises a first lateral cutout formed between a first edge of the blade and a midline of the blade; and a second lateral cutout formed between a second edge of the blade and the midline of the blade. In some embodiments, the one or more cutouts comprise internal cutouts formed relative to a midline of the blade. In some embodiments, the one or more cutouts comprise a first portion formed orthogonal to a length of the blade and a second portion formed parallel to the length of the blade. In some embodiments, each blade comprises a linear section, a curved section and a transition section, wherein the one or more cutouts are formed in a transition section between the linear section and the curved section.

Embodiments may be generally directed to a blade for a low-noise fan. The blade may comprise two surfaces, wherein a first surface of the two surfaces is a front surface based on a direction of rotation and a second surface of the two surfaces is a back surface based on the direction of rotation; a linear section extending from a hub a first distance; a curved section extending a second distance to an end of the blade; a transition section between the linear section and the curved section; and one or more cutouts, wherein air flowing along the front surface in the linear section is generally laminar flow, air flowing along the front surface in the curved section is generally turbulent flow, and a portion of the air flowing along the front surface passes through the one or more cutouts to flow relative to the back surface. In some embodiments, the one or more cutouts comprise a lateral cutout formed between an edge of the blade. In some embodiments, the one or more cutouts comprises a first lateral cutout formed between a first edge of the blade and a midline of the blade; and a second lateral cutout formed between a second edge of the blade and the midline of the blade. In some embodiments, the one or more cutouts comprise internal cutouts formed relative to a midline of the blade. In some embodiments, the one or more cutouts comprise a first portion formed orthogonal to a length of the blade and a second portion formed parallel to the length of the blade.

BRIEF DESCRIPTION OF THE DRAWINGS

For a more complete understanding of the present disclosure and its features/advantages, reference is now made to the following description, taken in conjunction with the accompanying drawings, which are not drawn to scale, and in which.

DETAILED DESCRIPTION

Figure 1:
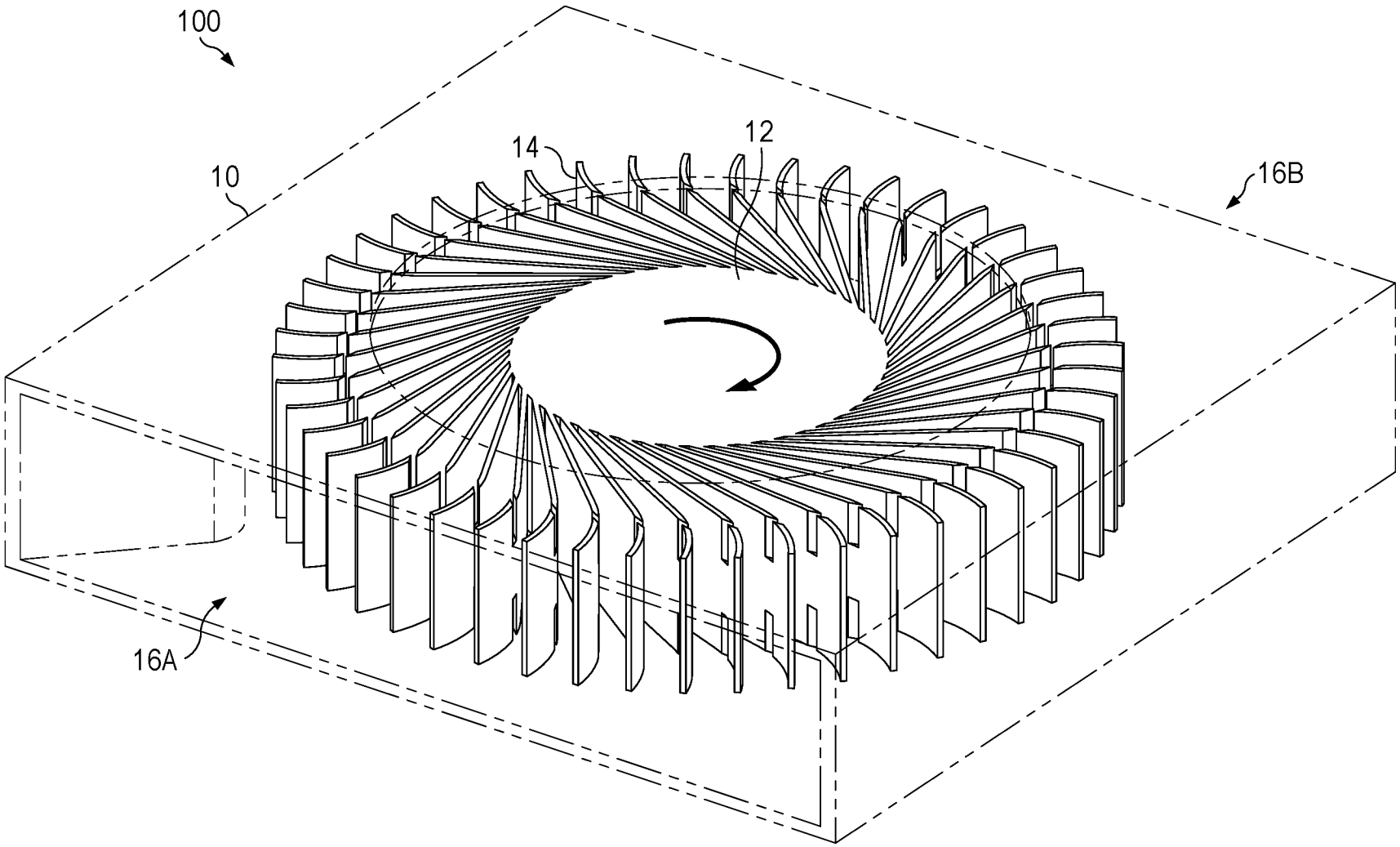
FIG. 1 depicts a perspective view of an embodiment of a fan for cooling an information handling system, the fan having a plurality of blades and each blade having a cutout a radial distance from a hub.

In the following description, details are set forth by way of example to facilitate discussion of the disclosed subject matter. It should be apparent to a person of ordinary skill in the field, however, that the disclosed embodiments are examples and not exhaustive of all possible embodiments.

As used herein, a reference numeral refers to a class or type of entity, and any letter following such reference numeral refers to a specific instance of a particular entity of that class or type. Thus, for example, a hypothetical entity referenced by '12A' may refer to a particular instance of a particular class/type, and the reference '12' may refer to a collection of instances belonging to that particular class/type or any one instance of that class/type in general.

An information handling system (IHS) may include a hardware resource or an aggregate of hardware resources operable to compute, classify, process, transmit, receive, retrieve, originate, switch, store, display, manifest, detect, record, reproduce, handle, and/or utilize various forms of information, intelligence, or data for business, scientific, control, entertainment, or other purposes, according to one or more embodiments. For example, an IHS may be a personal computer, a desktop computer system, a laptop computer system, a server computer system, a mobile device, a tablet computing device, a personal digital assistant (PDA), a consumer electronic device, an electronic music player, an electronic camera, an electronic video player, a wireless access point, a network storage device, or another suitable device and may vary in size, shape, performance, functionality, and price. In one or more embodiments, a portable IHS may include or have a form factor of that of or similar to one or more of a laptop, a notebook, a telephone, a tablet, and a PDA, among others. For example, a portable IHS may be readily carried and/or transported by a user (e.g., a person). In one or more embodiments, components of an IHS may include one or more storage devices, one or more communications ports for communicating with external devices as well as various input and output (I/O) devices, such as a keyboard, a mouse, and a video display, among others. In one or more embodiments, IHS may include one or more buses operable to transmit communication between or among two or more hardware components. In one example, a bus of an IHS may include one or more of a memory bus, a peripheral bus, and a local bus, among others. In another example, a bus of an IHS may include one or more of a Micro Channel Architecture (MCA) bus, an Industry Standard Architecture (ISA) bus, an Enhanced ISA (EISA) bus, a Peripheral Component Interconnect (PCI) bus, HyperTransport (HT) bus, an inter-integrated circuit ($I^2C$) bus, a serial peripheral interface (SPI) bus, a low pin count (LPC) bus, an enhanced serial peripheral interface (eSPI) bus, a universal serial bus (USB), a system management bus (SMBus), and a Video Electronics Standards Association (VESA) local bus, among others.

In one or more embodiments, an IHS may include firmware that controls and/or communicates with one or more hard drives, network circuitry, one or more memory devices, one or more I/O devices, and/or one or more other peripheral devices. For example, firmware may include software embedded in an IHS component utilized to perform tasks. In one or more embodiments, firmware may be stored in non-volatile memory, such as storage that does not lose stored data upon loss of power. In one example, firmware associated with an IHS component may be stored in non-volatile memory that is accessible to one or more IHS components. In another example, firmware associated with an IHS component may be stored in non-volatile memory that may be dedicated to and includes part of that component. For instance, an embedded controller may include firmware that may be stored via non-volatile memory that may be dedicated to and includes part of the embedded controller.

An IHS may include a processor, a volatile memory medium, non-volatile memory media, an I/O subsystem, and a network interface. Volatile memory medium, non-volatile memory media, I/O subsystem, and network interface may be communicatively coupled to processor. In one or more embodiments, one or more of volatile memory medium, non-volatile memory media, I/O subsystem, and network interface may be communicatively coupled to processor via one or more buses, one or more switches, and/or one or more root complexes, among others. In one example, one or more of a volatile memory medium, non-volatile memory media, an I/O subsystem, a and network interface may be communicatively coupled to the processor via one or more PCI-Express (PCIe) root complexes. In another example, one or more of an I/O subsystem and a network interface may be communicatively coupled to processor via one or more PCIe switches.

In one or more embodiments, the term "memory medium" may mean a "storage device", a "memory", a "memory device", a "tangible computer readable storage medium", and/or a "computer-readable medium". For example, computer-readable media may include, without limitation, storage media such as a direct access storage device (e.g., a hard disk drive, a floppy disk, etc.), a sequential access storage device (e.g., a tape disk drive), a compact disk (CD), a CD-ROM, a digital versatile disc (DVD), a random access memory (RAM), a read-only memory (ROM), a one-time programmable (OTP) memory, an electrically erasable programmable read-only memory (EEPROM), and/or a flash memory, a solid state drive (SSD), or any combination of the foregoing, among others.

In one or more embodiments, one or more protocols may be utilized in transferring data to and/or from a memory medium. For example, the one or more protocols may include one or more of small computer system interface (SCSI), Serial Attached SCSI (SAS) or another transport that operates with the SCSI protocol, advanced technology attachment (ATA), serial ATA (SATA), a USB interface, an Institute of Electrical and Electronics Engineers (IEEE) 1394 interface, a Thunderbolt interface, an advanced technology attachment packet interface (ATAPI), serial storage architecture (SSA), integrated drive electronics (IDE), or any combination thereof, among others.

A volatile memory medium may include volatile storage such as, for example, RAM, DRAM (dynamic RAM), EDO RAM (extended data out RAM), SRAM (static RAM), etc. One or more of non-volatile memory media may include nonvolatile storage such as, for example, a read only memory (ROM), a programmable ROM (PROM), an erasable PROM (EPROM), an electrically erasable PROM, NVRAM (non-volatile RAM), ferroelectric RAM (FRAM), a magnetic medium (e.g., a hard drive, a floppy disk, a magnetic tape, etc.), optical storage (e.g., a CD, a DVD, a BLU-RAY disc, etc.), flash memory, a SSD, etc. In one or more embodiments, a memory medium can include one or more volatile storages and/or one or more nonvolatile storages.

In one or more embodiments, a network interface may be utilized in communicating with one or more networks and/or one or more other information handling systems. In one example, network interface may enable an IHS to communicate via a network utilizing a suitable transmission protocol and/or standard. In a second example, a network interface may be coupled to a wired network. In a third example, a network interface may be coupled to an optical network. In another example, a network interface may be coupled to a wireless network. In one instance, the wireless network may include a cellular telephone network. In a second instance, the wireless network may include a satellite telephone network. In another instance, the wireless network may include a wireless Ethernet network (e.g., a Wi-Fi network, an IEEE 802.11 network, etc.).

In one or more embodiments, a network interface may be communicatively coupled via a network to a network storage resource. For example, the network may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, an Internet or another appropriate architecture or system that facilitates the communication of signals, data and/or messages (generally referred to as data). For instance, the network may transmit data utilizing a desired storage and/or communication protocol, including one or more of Fibre Channel, Frame Relay, Asynchronous Transfer Mode (ATM), Internet protocol (IP), other packet-based protocol, Internet SCSI (iSCSI), or any combination thereof, among others.

In one or more embodiments, a processor may execute processor instructions in implementing at least a portion of one or more systems, at least a portion of one or more flowcharts, at least a portion of one or more methods, and/or at least a portion of one or more processes. In one example, a processor may execute processor instructions from one or more memory media in implementing at least a portion of one or more systems, at least a portion of one or more flowcharts, at least a portion of one or more methods, and/or at least a portion of one or more processes. In another example, a processor may execute processor instructions via a network interface in implementing at least a portion of one or more systems, at least a portion of one or more flowcharts, at least a portion of one or more methods, and/or at least a portion of one or more processes.

In one or more embodiments, a processor may include one or more of a system, a device, and an apparatus operable to interpret and/or execute program instructions and/or process data, among others, and may include one or more of a microprocessor, a microcontroller, a digital signal processor (DSP), an application specific integrated circuit (ASIC), and another digital or analog circuitry configured to interpret and/or execute program instructions and/or process data, among others. In one example, a processor may interpret and/or execute program instructions and/or process data stored locally (e.g., via memory media and/or another component of an IHS). In another example, a processor may interpret and/or execute program instructions and/or process data stored remotely (e.g., via a network storage resource).

In one or more embodiments, an I/O subsystem may represent a variety of communication interfaces, graphics interfaces, video interfaces, user input interfaces, and/or peripheral interfaces, among others. For example, an I/O subsystem may include one or more of a touch panel and a display adapter, among others. For instance, a touch panel may include circuitry that enables touch functionality in conjunction with a display that is driven by a display adapter.

A non-volatile memory medium may include an operating system (OS) and applications (APPs). In one or more embodiments, one or more of an OS and APPs may include processor instructions executable by a processor. In one example, a processor may execute processor instructions of one or more of OS and APPs via a non-volatile memory medium. In another example, one or more portions of the processor instructions of one or more of an OS and APPs may be transferred to a volatile memory medium and a processor may execute the one or more portions of the processor instructions.

Non-volatile memory medium may include information handling system firmware (IHSFW). In one or more embodiments, IHSFW may include processor instructions executable by a processor. For example, IHSFW may include one or more structures and/or one or more functionalities of and/or compliant with one or more of a basic input/output system (BIOS), an Extensible Firmware Interface (EFI), a Unified Extensible Firmware Interface (UEFI), and an Advanced Configuration and Power Interface (ACPI), among others. In one instance, a processor may execute processor instructions of IHSFW via non-volatile memory medium. In another instance, one or more portions of the processor instructions of IHSFW may be transferred to volatile memory medium, and processor may execute the one or more portions of the processor instructions of IHSFW via volatile memory medium.

Cooling systems for information handling systems described above generally include a fan configured to generate an airflow in a chassis. A fan produces two types of acoustic noise: one is the structural borne noise caused by the mechanical vibration such as bearing/shaft wobbling, and the other air borne noise induced by the air movement, (i.e., aeroacoustics). Aeroacoustic noise is primarily generated by chaotic flow movement (e.g., turbulent flow), and its interaction with the solid surfaces.

Fan noise is always a challenge for laptop information handling systems. Being a mobile device, laptop design has been constantly driven towards smaller and thinner chassis, leaving limited space for fans and thermal modules, forcing the fan to run faster (and therefore louder) to reject the ever-increasing heat. Home and hybrid work environments require a lower fan noise level due to a much quieter environment. For example, some homes can be as quiet as 23 dBA vs 40 dBA for a typical office environment.

Laptop fan noise levels have been lowered over generations. For example, some laptop fan noise has been reduced from 2.5 sones to 1.1 sones in recent generations. The reduction may have been achieved with new technologies including dual opposed outlet (DOO) fans and increasing fan size. However, further increasing fan size may not be feasible due to the need to fit the fan into a standard form factor. A manufacturer of laptop information handling systems may try to reduce fan noise to continue improving user experience and enable decreased fan size without impacting system airflow.

Embodiments described herein may reduce aeroacoustic noise through reduction of flow turbulence across fan blades, providing for a quieter user experience but still capable of generating enough airflow to cool components in a chassis.

Figure 2:
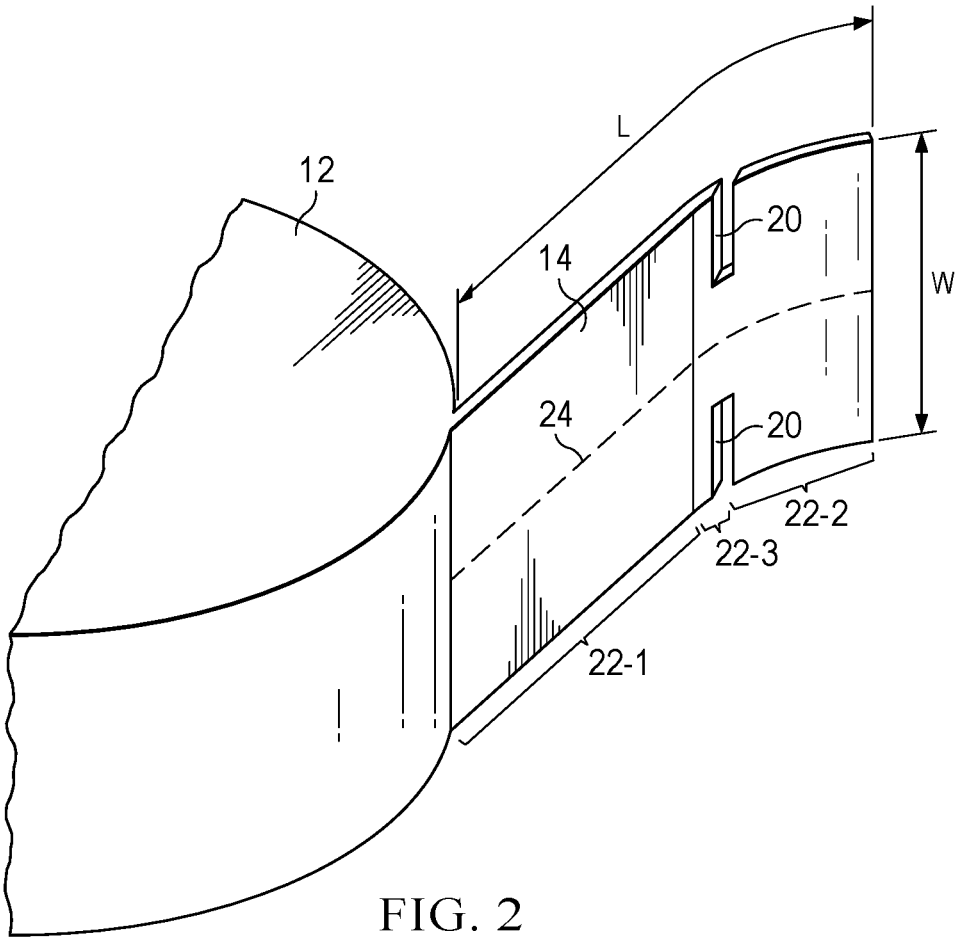
FIG. 2 depicts a close-up partial perspective view of the embodiment of a fan for cooling an information handling system, illustrating each blade having a pair of lateral cutouts in a transition section between a linear section and a curved section.

Turning now to FIGS. 1 and 2, in some embodiments, low noise fan 100 comprises fan housing 10, hub 12 rotatably positioned in fan housing 10 and a plurality of blades 14 coupled to hub 12. A motor (not shown) rotates hub 12, wherein the plurality of blades 14 draw air into fan housing 10 through an intake opening and generate one or more airflows. Airflow generated by fan 100 may exit either a first exit opening 16A or a second exit opening 16B opposite first exit opening 16A.

As depicted in FIG. 2, each blade 14 may extend a length (L) from hub 12 and has a width (W) between two edges. Each blade 14 comprises two surfaces, wherein a first surface (e.g., a front surface based on a rotation direction of hub 12) and a second surface (e.g., a back surface based on the rotation direction of hub 12). Each blade 14 may be configured with one or more cutouts 20 to reduce flow turbulence, discussed in greater detail below.

Aeroacoustics Improve Using Blades with One or More Cutouts

When blades 14 are rotating around hub 12, a stall region forms behind each blade 14, wherein the flow becomes unstable, chaotic and turbulent, creating fan noise. Embodiments may reduce the aeroacoustic noise by reducing the turbulent airflow movement in or near the blade zone by diverting some laminar airflow from a front surface to the back side of blades 14 (wherein the terms "front" and "back" may refer with respect to the blade rotational direction).

Embodiments may comprise one or more cutouts 20 formed in blades 14 to reduce fan noise, wherein each cutout 20 forms a bypass channel allowing laminar airflow on the front surface of a blade 14 to pass through blade 14 to a back side of blade 14, reducing the turbulence and aeroacoustic noise. Although the pressure difference (e.g., the difference in pressure between the front surface of blade 14 and the rear surface of blade 14) is reduced, an overall sound level vs. flow ratio efficiency is gained, resulting in more volumetric flow rate (e.g., cubic feet per minute or CFM) per decibel (dB). Advantageously, maintaining laminar flow further along a blade surface increases the efficiency of the fan 100, and at the same time reduces the acoustic signature.

In some embodiments, a length (L) of blades 14 may be defined by a linear section 22-1, a curved section 22-2 and a transition section 22-3. In some embodiments, linear section 22-1 corresponds to a radial distance over which flow is laminar, curved section 22-2 corresponds to a radial distance after which flow is turbulent and transition section 22-3 corresponds to a radial distance at which laminar flow transitions to turbulent flow. In some embodiments, blades 14 have one or more cutouts 20 formed in a transition section 22-3 through which laminar airflow can go directly from a front side of blade 14 to a back side of blade 14.

Cutouts 20 may be formed with a cutout width and a cutout height to allow a portion of the airflow generated by blade 14 to pass through blade 14. As depicted in FIG. 2, one or more cutouts 20 may be lateral cutouts 20 (also referred to as slots 20), wherein slots 20 formed in blade 14 are connected to an edge of blade 14 and airflow along a front surface of blade 14 may pass through slots 20 to the back side of blade 14. In some embodiments, two slots 20 may be formed symmetric to midline 24 (e.g., a first slot 20 on a first side of midline 24 and a second slot 20 formed on a second side of midline 24). Slots 20 may be formed orthogonal to midline 24 or at a non-orthogonal angle relative to midline 24. Advantageously, embodiments in which blades 14 have slots 20 may be moldable (e.g., injection molded) for low-cost implementation.

Table 1 contains simulation results comparing blades 14 with continuous surfaces against blades 14 having lateral cutouts 20. As shown in Table 1, blades 14 with lateral cutouts 20 may need to operate at a higher RPM (e.g., 5274 RPM vs 5000 RPM) to achieve the same flow rate (e.g., 17.3 CFM) as a baseline fan with blades 14 having continuous surfaces.

TABLE 1

| ISO CFM | Baseline | Blades with cutouts |
|---|---|---|
| RPM | 5000 | 5274 |
| Flow Rate (CFM) | 17.3 | 17.3 |
| Blower air volume acoustic power interval (W/m^3/m^3) | 1.549E−11 | 1.488E−11 |
| dB per 1E−12 reference | 23.8 | 23.5 |
| dB change | 0.0 | −0.3 |
| Blower blade surface acoustic power interval (W/m^3/m^3) | 1.342E−10 | 8.242E−11 |
| dB per 1E−12 reference | 42.6 | 38.3 |
| dB change | 0.0 | −4.2 |

Figure 3:
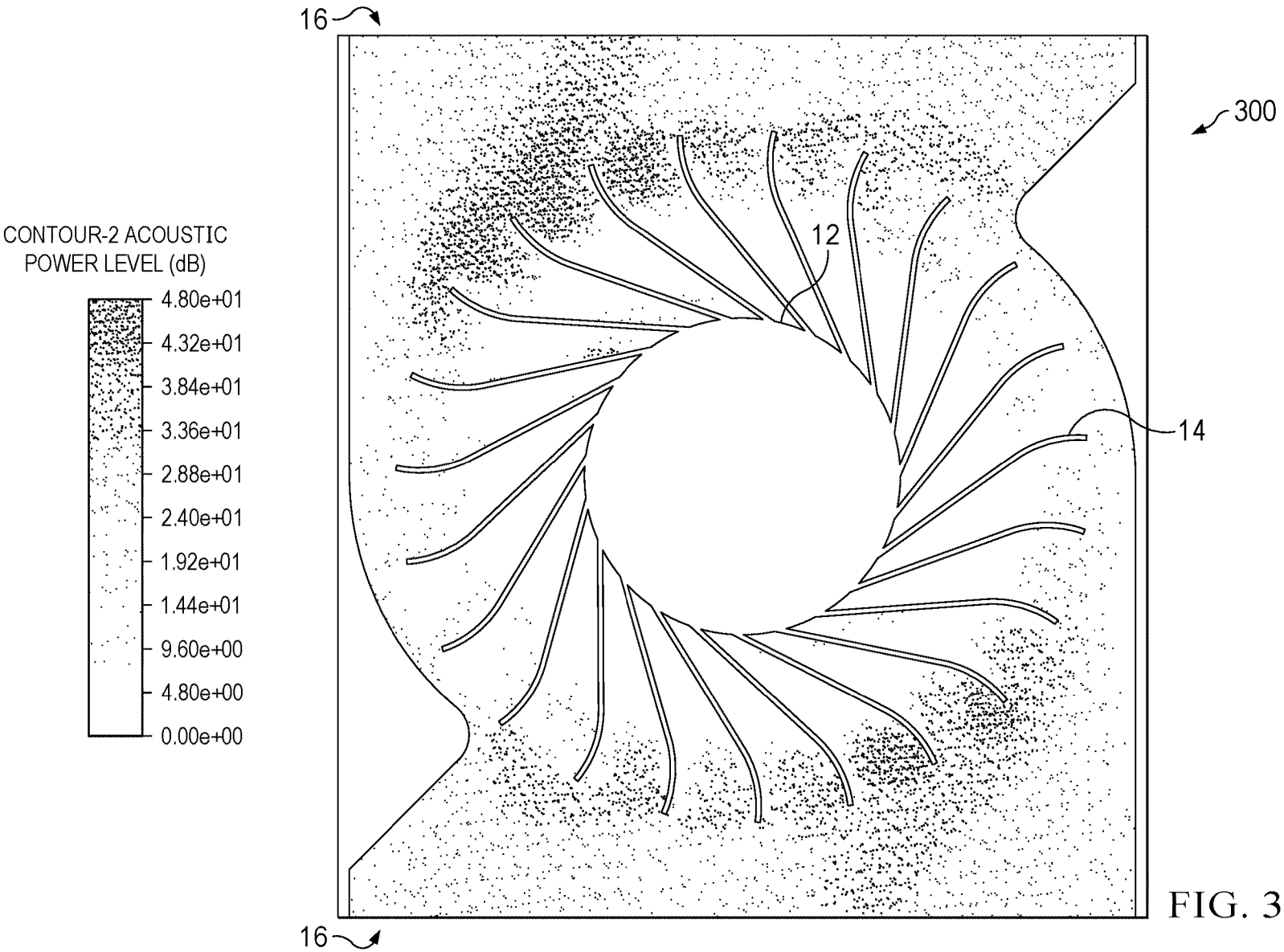
FIG. 3 depicts a simulated acoustic profile of a common fan having a plurality of blades with continuous surfaces over a length of the blades.
Figure 4:
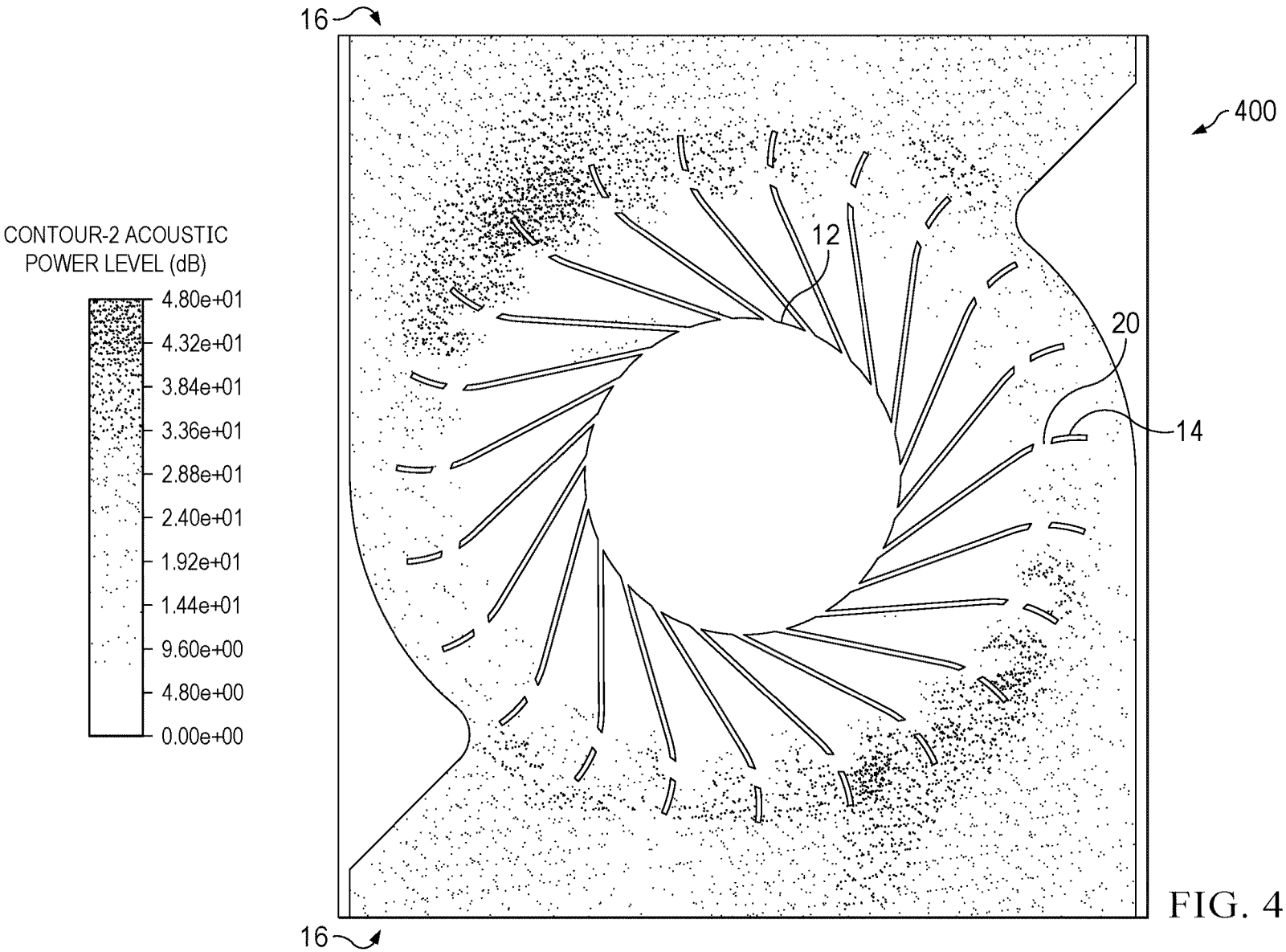
FIG. 4 depicts a simulated acoustic profile of an embodiment of a low-noise fan having a plurality of blades with one or more cutouts formed in each blade.

However, even with the higher RPMs, fan 100 having blades 14 with lateral cutouts 20 may operate at 4.2 dB quieter than a fan with blades 14 having continuous surfaces. Referring to FIGS. 3 and 4, FIG. 3 depicts a simulated acoustic profile 300 of a fan in a fan housing having two opposed outlets 16, with a rotating hub 12 having a plurality of blades 14 with continuous surfaces over a length of each blade 14 and FIG. 4 depicts a simulated acoustic profile 400 of fan 100, also in a fan housing having two opposed outlets 16 and hub 12, but with a plurality of blades 14 having one or more cutouts 20 to allow laminar airflow from a first side (e.g., a front side based on clockwise rotation of hub 12) to a second side (e.g., a back side based on clockwise rotation of hub 12) of blades 14. Airflow may exit a fan housing through one of two outlets 16.

Figure 5:
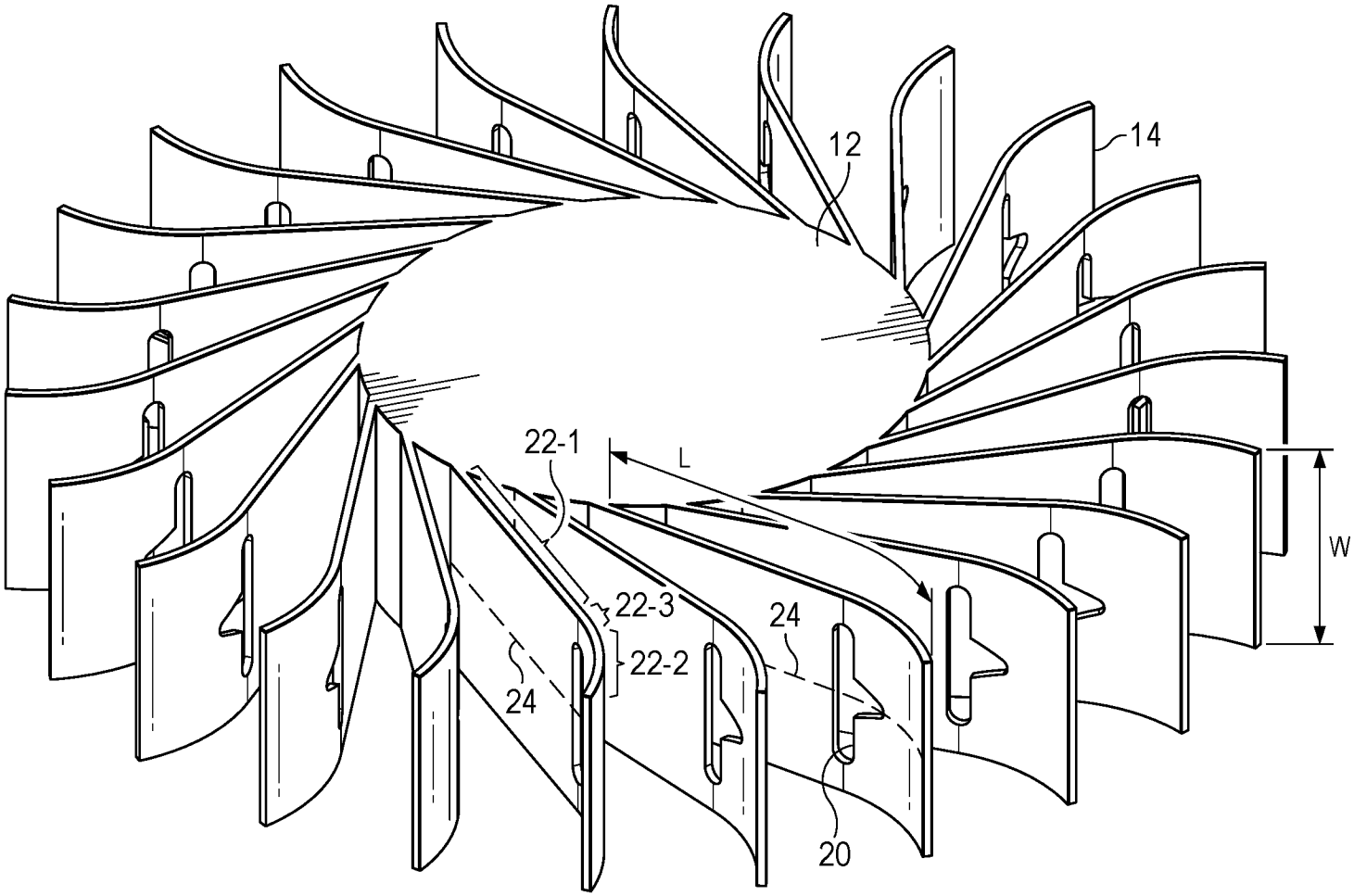
FIG. 5 depicts a perspective view of an embodiment of a low-noise fan for cooling an information handling system, the fan having a plurality of blades and each blade having a cutout formed relative to a midline of the blade and at a radial distance from a hub.

Referring to FIG. 5, in some embodiments, one or more cutouts 20 may be formed internal to blade 14, wherein the one or more internal cutouts 20 may be formed relative to midline 24 and may extend towards one or more edges of blades 14, but do not join with an edge of blades 14. In some embodiments, one or more internal cutouts 20 may be formed symmetric relative to midline 24 of blade 14. In some embodiments, one or more internal cutouts 20 may be formed relative to midline 24 of blade 14 and orthogonal to a length of blade 14. In some embodiments, one or more internal cutouts 20 may be formed relative to midline 24 of blade 14 and parallel to the length of the blade 14. As depicted in FIG. 5, in some embodiments, internal cutouts 20 may be formed relative to midline 24 of blade 14 and comprise a first portion formed orthogonal to a length of blade 14 and a second portion formed parallel to the length of blade 14. Embodiments with internal cutouts 20 formed relative to midline 24 may be implemented in materials such as sheet metal or using 3D additive technologies.

Figure 6:
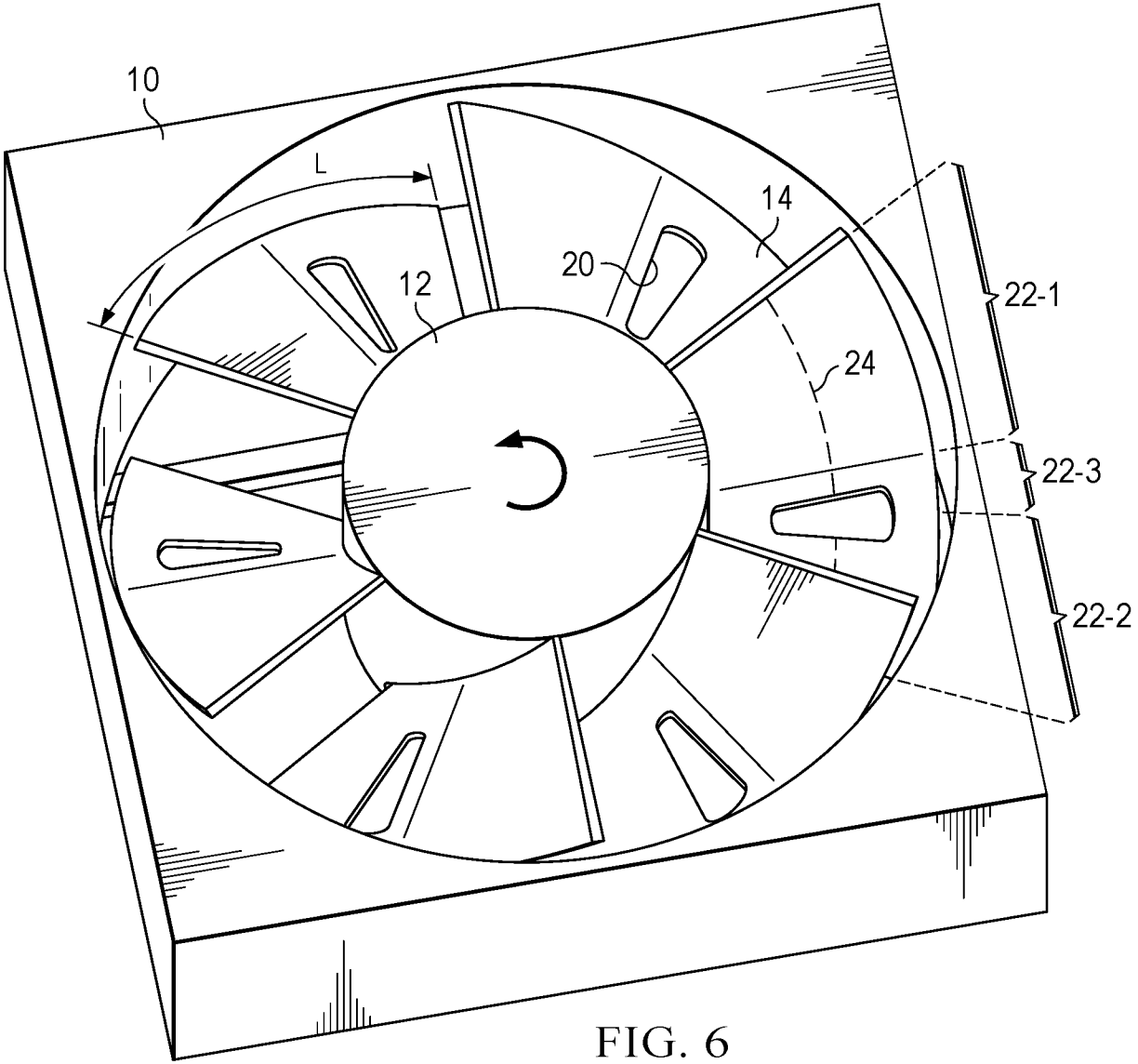
FIG. 6 depicts a perspective view of an embodiment of a low-noise fan for cooling an information handling system, the fan having a plurality of blades and each blade having a cutout formed relative to a midline of the blade and relative to a length of the blade.

Referring to FIG. 6, in some embodiments, one or more cutouts 20 may be formed relative to midline 24 of blade 14 of an axial fan assembly 600, wherein the one or more cutouts 20 may extend towards one or more edges of blades 14 but do not join with an edge of blades 14. As depicted in FIG. 6, cutouts 20 may have a first width radially closer to hub 12 and a second width radially outward from hub 12. In some embodiments, the second width may be larger than the first width. In some embodiments, the first width and the second width are proportional to a length of cutouts 20.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A low noise fan, comprising:

a fan housing;

a hub rotatably positioned in the fan housing; and a plurality of blades coupled to the hub, each blade comprising:

a linear section positioned at a proximal end of the blade adjacent to the hub, the linear section corresponding to laminar air flow;

a curved section positioned at a distal end of the blade from the hub, the curved section corresponding to a turbulent air flow;

a transition section connecting the linear section to the curved section, the transition section corresponding to a transition of the laminar air flow to the turbulent air flow at the blade; and one or more cutouts formed a radial distance from the hub and formed in the transition section such that each cutout is spaced-apart from the distal end of the blade, wherein each cutout is formed with a cutout width that is substantially constant along the cutout, and wherein each cutout is i) at a non-orthogonal angle with respect to a midline of the blade and ii) angled with respect to a surface of the blade.

2. The low noise fan of claim 1, wherein the one or more cutouts are formed between an edge of a blade of the plurality of blades and the midline of the blade.

3. A cooling system for an information handling system, the cooling system comprising:

a motor;

a fan assembly comprising:

a fan housing;

a hub coupled to an output shaft of the motor and positioned in the fan housing; and a plurality of blades coupled to the hub, each blade comprising:

a linear section positioned at a proximal end of the blade adjacent to the hub, the linear section corresponding to a laminar air flow;

a curved section positioned at a distal end of the blade from the hub, the curved section corresponding to a turbulent air flow;

a transition section connecting positioned between the linear section to the curved section, the transition section corresponding to a transition of the laminar air flow to the turbulent air flow at the blade; and one or more cutouts formed a radial distance from the hub and formed in the transition section such that each cutout is spaced-apart from the distal end of the blade, wherein each cutout is formed with a cutout width that is substantially constant along the cutout, and wherein each cutout is i) at a non-orthogonal angle with respect to a midline of the blade and ii) angled with respect to a surface of the blade.

4. The cooling system of claim 3, wherein the one or more cutouts are formed between an edge of a blade of the plurality of blades and the midline of the blade.

5. A blade for a low-noise fan, the blade comprising:

two surfaces, wherein a first surface of the two surfaces is a front surface based on a direction of rotation and a second surface of the two surfaces is a back surface based on the direction of rotation;

a linear section positioned at a proximal end of the blade adjacent to the hub, the linear section corresponding to a laminar air flow;

a curved section positioned at a distal end of the blade from the hub, the curved section corresponding to a turbulent air flow;

a transition section connecting between the linear section to the curved section, the transition section corresponding to a transition of the laminar air flow to the turbulent air flow at the blade; and one or more cutouts formed a radial distance from the hub and formed in the transition section such that each cutout is spaced-apart from the distal end of the blade, wherein air flowing along the front surface in the linear section is generally laminar flow, air flowing along the front surface in the curved section is generally turbulent flow, and a portion of the air flowing along the front surface passes through the one or more cutouts to flow relative to the back surface, wherein each of the cutouts is formed with a cutout width that is substantially constant along the cutout, and wherein each of the cutouts is i) at a non-orthogonal angle with respect to a midline of the blade and ii) angled with respect to the two surfaces of the blade.

6. The blade of claim 5, wherein the one or more cutouts are formed between an edge of the blade.

* * * * *